US010617232B2

(12) United States Patent
Taylor et al.

(10) Patent No.: US 10,617,232 B2
(45) Date of Patent: Apr. 14, 2020

(54) SHELVING SYSTEM HAVING STOWABLE SHELVES

(71) Applicant: Walmart Apollo, LLC, Bentonville, AR (US)

(72) Inventors: Robert James Taylor, Rogers, AR (US); Matthew D. Alexander, Rogers, AR (US)

(73) Assignee: Walmart Apollo, LLC, Bentonville, AR (US)

( * ) Notice: Subject to any disclaimer, the term of this patent is extended or adjusted under 35 U.S.C. 154(b) by 0 days.

(21) Appl. No.: 15/730,023

(22) Filed: Oct. 11, 2017

(65) Prior Publication Data

US 2018/0103781 A1 Apr. 19, 2018

Related U.S. Application Data

(60) Provisional application No. 62/409,496, filed on Oct. 18, 2016.

(51) Int. Cl.

| | |
|---|---|
| ***A47F 5/10*** | (2006.01) |
| ***A47B 57/06*** | (2006.01) |
| *A47F 10/02* | (2006.01) |

(52) U.S. Cl.

CPC ..... *A47F 5/103* (2013.01); *A47B 57/06* (2013.01); *A47F 10/02* (2013.01)

(58) Field of Classification Search

CPC ..... A47F 5/103; A47F 10/02; A47B 57/06
USPC ..... 211/186, 187, 134, 153, 90.01, 90.02, 211/86.01; 108/106–108, 147.11, 144.11; 248/239, 243–246

See application file for complete search history.

(56) References Cited

U.S. PATENT DOCUMENTS 388,066 A * 8/1888 Murphy ..... A47B 57/16 108/110
427,462 A * 5/1890 Crider ..... A47B 57/567 248/244

(Continued)

FOREIGN PATENT DOCUMENTS

WO 2012125960 A3 9/2012

OTHER PUBLICATIONS

International Search Report & Written Opinion in International Patent Application No. PCT/US17/56095, dated Dec. 22, 2017; 13 pages.

(Continued)

*Primary Examiner* — Jonathan Liu
*Assistant Examiner* — Devin K Barnett
(74) *Attorney, Agent, or Firm* — Schmeiser, Olsen & Watts LLP

(57) ABSTRACT

A shelving system is provided, which includes a plurality of supports, each support of the plurality of supports having a longitudinal opening defining a channel extending from a first end to a second end of the support, the plurality of supports having at least one opening positioned on a surface of the plurality of supports, at least one shelf, the at least one shelf including an extension, the extension being positioned within the channel of each of the plurality of supports to allow a vertical movement of the at least one shelf with respect to the plurality of supports; and an actuator operably coupled to the at least one shelf, wherein actuation of the actuator permits the vertical movement of the at least one shelf within the channel. Furthermore, an associated method is also provided.

10 Claims, 9 Drawing Sheets

(56) References Cited

U.S. PATENT DOCUMENTS 569,640 A * 10/1896 Hartzell ..... A47B 57/567 248/244
716,852 A * 12/1902 Baker ..... A47B 57/567 248/244
845,917 A * 3/1907 Worley ..... A47B 96/067 108/108
926,304 A * 6/1909 Thompson ..... A47G 19/26 312/284
1,133,696 A * 3/1915 Barbora ..... A47B 13/081 108/140
1,614,342 A * 1/1927 Bleckley ..... A47G 21/14 211/70.6
1,820,427 A * 8/1931 Birmann ..... B66B 5/26 187/349
1,941,838 A * 1/1934 Hyams ..... A47B 57/045 108/108
2,005,057 A * 6/1935 Summers ..... F25D 25/02 211/153
2,146,950 A * 2/1939 Foster ..... A47B 57/20 211/153
2,634,188 A * 4/1953 Davis ..... A47B 77/04 312/247
2,644,591 A * 7/1953 McMahan ..... A47F 5/103 211/187
2,692,177 A * 10/1954 Larsen ..... B65G 1/07 267/287
2,717,085 A * 9/1955 Waddington ..... B65G 1/07 211/59.3
2,802,575 A * 8/1957 Jeune ..... B65G 1/07 108/106
2,910,335 A * 10/1959 Wales ..... A47B 51/00 126/19 M
2,956,688 A * 10/1960 Galassi ..... A47F 5/103 108/108
3,128,074 A * 4/1964 Schwarz ..... A47B 57/567 108/108
3,234,897 A * 2/1966 Berk ..... A47B 57/42 108/108
3,982,801 A * 9/1976 Heidorn ..... A47B 57/06 312/306
4,122,957 A * 10/1978 Allen ..... B66F 9/0755 187/399
4,250,815 A * 2/1981 Swanson ..... A47F 5/13 108/108
4,292,902 A * 10/1981 Barrineau ..... A47F 5/13 108/110
4,329,928 A * 5/1982 Shaw ..... A47B 51/00 108/106
4,421,289 A * 12/1983 Sturm ..... A47B 57/56 108/108
4,603,782 A * 8/1986 Fenwick ..... A47B 57/20 108/107
4,614,273 A * 9/1986 Ishii ..... A47B 57/56 211/183
4,618,063 A * 10/1986 Mendenhall ..... A47F 5/005 211/184
4,619,208 A * 10/1986 Kurrasch ..... A47B 9/12 108/106
4,627,542 A * 12/1986 Fredrickson ..... A47F 5/12 211/150
4,651,652 A * 3/1987 Wyckoff ..... A47B 9/12 108/147
4,793,497 A 12/1988 Hall et al.
4,890,748 A 1/1990 Visser
4,895,331 A * 1/1990 Nehls ..... A47B 57/565 108/108
4,912,359 A * 3/1990 Offutt ..... A47B 51/00 108/147
4,915,461 A * 4/1990 Kingsborough ..... A47B 77/10 312/247
4,919,282 A * 4/1990 Duff ..... A47B 57/26 211/134
4,972,783 A * 11/1990 Crissman ..... A47B 47/025 108/107
5,148,927 A * 9/1992 Gebka ..... A47F 5/005 108/60
5,199,778 A * 4/1993 Aoki ..... A47B 57/32 108/147
5,349,909 A * 9/1994 Smit ..... A47B 96/06 108/107
5,549,054 A * 8/1996 Lewis ..... A47B 96/025 108/152
5,624,169 A * 4/1997 Bishop, Jr. ..... A47B 51/00 187/404
5,799,588 A * 9/1998 Engel ..... A47B 57/06 108/108
5,924,367 A * 7/1999 Henke ..... A47F 5/0087 108/108
5,963,920 A 10/1999 Rose et al.
6,065,821 A * 5/2000 Anderson ..... A47B 57/06 108/108
6,105,794 A * 8/2000 Bauer ..... A47B 57/26 108/108
6,158,600 A * 12/2000 Ferrucci ..... A47B 55/02 108/147.11
6,241,048 B1 * 6/2001 Heilmann ..... B66F 7/02 108/106
6,450,360 B1 * 9/2002 Hyde ..... B65G 1/07 108/136
6,550,724 B2 * 4/2003 Gosling ..... A47B 83/001 108/144.11
6,676,233 B1 * 1/2004 Evans ..... B66B 9/02 108/147.11
7,233,241 B2 6/2007 Overhultz et al.
7,380,766 B2 * 6/2008 Thompson ..... A47B 97/06 108/144.11
7,584,016 B2 9/2009 Weaver
7,669,945 B2 * 3/2010 Blersch ..... F25D 23/067 108/107
7,857,145 B2 * 12/2010 Mushan ..... A47B 88/43 211/26
8,061,788 B2 * 11/2011 Bocchini ..... A47F 3/0456 108/108
8,123,314 B2 * 2/2012 Becke ..... F25D 23/04 108/107
8,152,258 B2 * 4/2012 Kang ..... F25D 25/04 108/108
8,191,487 B2 * 6/2012 Theesfeld ..... A47B 57/06 108/106
8,226,184 B2 * 7/2012 Kang ..... A47B 57/06 108/108
8,333,448 B2 * 12/2012 Yoon ..... A47B 96/028 108/108
8,419,143 B2 * 4/2013 Shin ..... F25D 25/02 312/408
8,424,983 B1 * 4/2013 Strauss ..... A47B 51/00 312/247
8,529,001 B2 * 9/2013 Calvillo ..... F25D 25/02 312/408
8,556,093 B2 * 10/2013 Davis ..... A47B 57/00 211/175
8,789,712 B2 * 7/2014 Johnson ..... A47F 5/0025 211/71.01
8,985,032 B1 * 3/2015 Johnson ..... A47B 21/02 108/106
9,167,896 B1 * 10/2015 Wu ..... A47B 96/1441
9,266,674 B2 * 2/2016 Reimer ..... B65G 1/026
9,421,684 B1 * 8/2016 Walcher ..... B25H 5/00
9,611,975 B2 * 4/2017 Chinn ..... B60P 7/0815
9,683,775 B2 * 6/2017 Choo ..... F25D 25/02
10,094,575 B2 * 10/2018 Evans ..... F24C 15/30
10,126,042 B2 * 11/2018 Cetinyol ..... F25D 23/066
10,161,671 B2 * 12/2018 Chellappan ..... F25D 25/02
10,376,058 B2 * 8/2019 Bryan ..... A47B 57/06
2003/0189021 A1 * 10/2003 Engel ..... A47B 57/06 211/187
2004/0050812 A1 * 3/2004 Rojas ..... A47F 5/0068 211/134

(56) References Cited

U.S. PATENT DOCUMENTS

2005/0006331 A1* 1/2005 Engel ..... A47F 3/063 211/151
2006/0071774 A1 4/2006 Brown et al.
2007/0140817 A1* 6/2007 Hansl ..... B66F 9/063 414/277
2009/0076650 A1* 3/2009 Faes ..... G07F 11/165 700/232
2009/0248198 A1 10/2009 Siegel et al.
2009/0255292 A1 10/2009 Benz
2010/0200526 A1* 8/2010 Barkdoll ..... A47F 1/126 211/59.3
2011/0239913 A1* 10/2011 Chung ..... B25H 1/18 108/146
2012/0031865 A1* 2/2012 Paeth ..... A47B 57/588 211/134
2012/0248046 A1* 10/2012 Warner ..... A47B 51/00 211/1.57
2014/0252930 A1* 9/2014 Reid ..... A47B 46/005 312/247
2014/0263128 A1* 9/2014 Garrett ..... A47F 5/0087 211/144
2015/0008203 A1* 1/2015 Misener ..... A47F 5/0068 211/134
2015/0096950 A1* 4/2015 Engel ..... A47B 46/00 211/90.02
2015/0323244 A1* 11/2015 Marts ..... A47B 57/485 312/408
2018/0103781 A1* 4/2018 Taylor ..... A47F 5/103
2018/0271281 A1* 9/2018 Bryan ..... A47F 3/06

OTHER PUBLICATIONS

International Preliminary Report for application No. PCT/US2017/056095 dated May 2, 2019.
Canadian Office Action for application No. 3,041,074 dated May 7, 2019.
English Examination report for application No. GB1905500.3 dated May 15, 2019.
British Exam Report for application No. GB1905500.3 dated Sep. 25, 2019.
British Exam Report for application No. GB1905500.3 dated Aug. 7, 2019.

* cited by examiner

SHELVING SYSTEM HAVING STOWABLE SHELVES

RELATED APPLICATIONS

This invention claims priority to U.S. provisional patent application Ser. No. 62/409,496, filed Oct. 18, 2016, entitled "Shelving System Having Stowable Shelves" the entirety of which is included herein by reference.

FIELD OF TECHNOLOGY

The following relates to a shelving system and more specifically to embodiments of a shelving system having stowable shelves that can be stowed away when not displaying a product.

BACKGROUND

Traditional shelving used in a retail environment displays products for purchase by customers. Product placed on a lower shelf can be hidden by the shelf located above the lower shelf, which stops customers from purchasing the products located on the lower shelf. Further, products placed on a higher shelf tend to be consumed by customers before the products placed on a lower shelf. This can result in a shelf with no products for sale that blocks a visibility to product located on the lower shelf. Current solutions, such as stacking product located on a higher shelf, can cause problems and is less effective because stacked product does not feed correctly and increases the risk of product damage.

Thus, a need exists for an apparatus and method for a shelving system having stowable shelves, and methods thereof.

SUMMARY

A first aspect relates generally to a shelving system, comprising a plurality of supports, each support of the plurality of supports having a longitudinal opening defining a channel extending from a first end to a second end of the support, the plurality of supports having at least one opening positioned on a surface of the plurality of supports, at least one shelf, the at least one shelf including an extension, the extension being positioned within the channel of each of the plurality of supports to allow a vertical movement of the at least one shelf with respect to the plurality of supports, and an actuator operably coupled to the at least one shelf, wherein actuation of the actuator permits the vertical movement of the at least one shelf within the channel A second aspect relates generally to a shelving system comprising a first support, the first support including a first plurality of cutouts along an inner surface of the first support, a second support, the second support including a second plurality of cutouts along an inner surface of the second support, wherein the second support is parallel to the first support, a first shelf, the first shelf including a first extension and a second extension, the first extension portion configured to vertically move within a channel of the first support, and the second extension portion configured to move vertically within a channel of the second support, and an actuator, the actuator operably coupled to the first shelf, and including an actuator arm that passes through at least one of the first plurality of cutouts and the second plurality of cutouts, wherein, as product placed on the first shelf is removed, the actuator is actuated to disengage the actuator arm from at least one of the first plurality of cutouts and the second plurality of cutouts such that the first shelf moves vertically towards a second shelf to stow away and create additional visibility to store product located on a third shelf, which is lower than the first shelf.

A third aspect relates generally to a method of creating additional space for visibility of products located on a lower shelf of a shelving system, comprising providing a plurality of supports, each support of the plurality of supports having a longitudinal opening defining a channel extending from a first end to a second end of the support, the plurality of supports having at least one opening positioned on a surface of the plurality of supports, connecting at least one shelf to the plurality of supports, wherein the at least one shelf includes an extension, the extension being positioned within the channel of the plurality of supports to allow a vertical movement of the at least one shelf with respect to the plurality of supports, and actuating an actuator operably coupled to the at least one shelf, wherein, in response to the actuating, an actuator arm of the actuator disengages from the at least one opening of the plurality of supports to permit a vertical movement of the at least one shelf to expose products placed on the lower shelf The foregoing and other features of construction and operation will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein.

DETAILED DESCRIPTION

A detailed description of the hereinafter described embodiments of the disclosed apparatus and method are presented herein by way of exemplification and not limitation with reference to the Figures. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1:
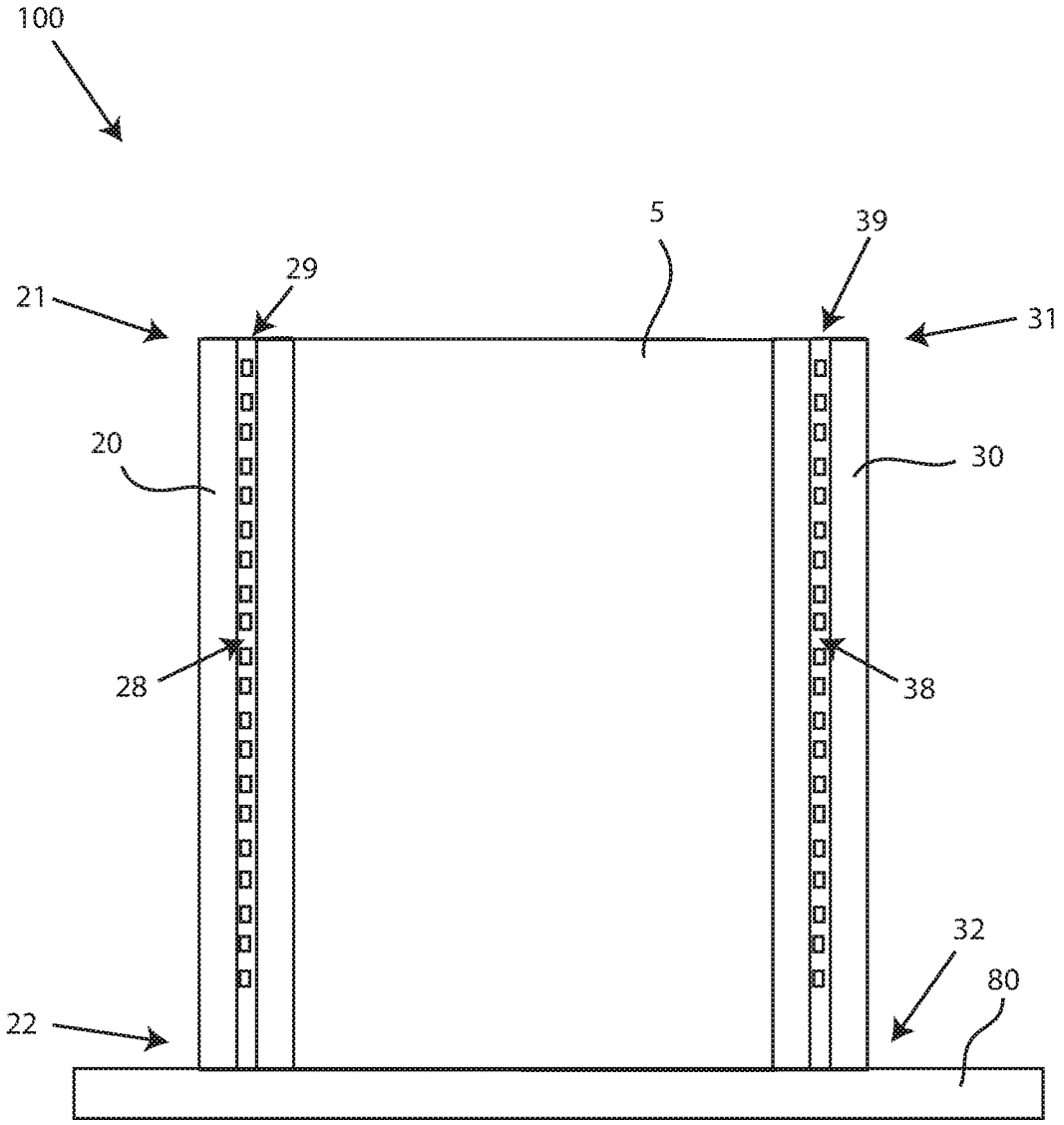
FIG. 1 depicts a front view of an embodiment of a shelving system, prior to shelves being coupled to supports.
Figure 2:
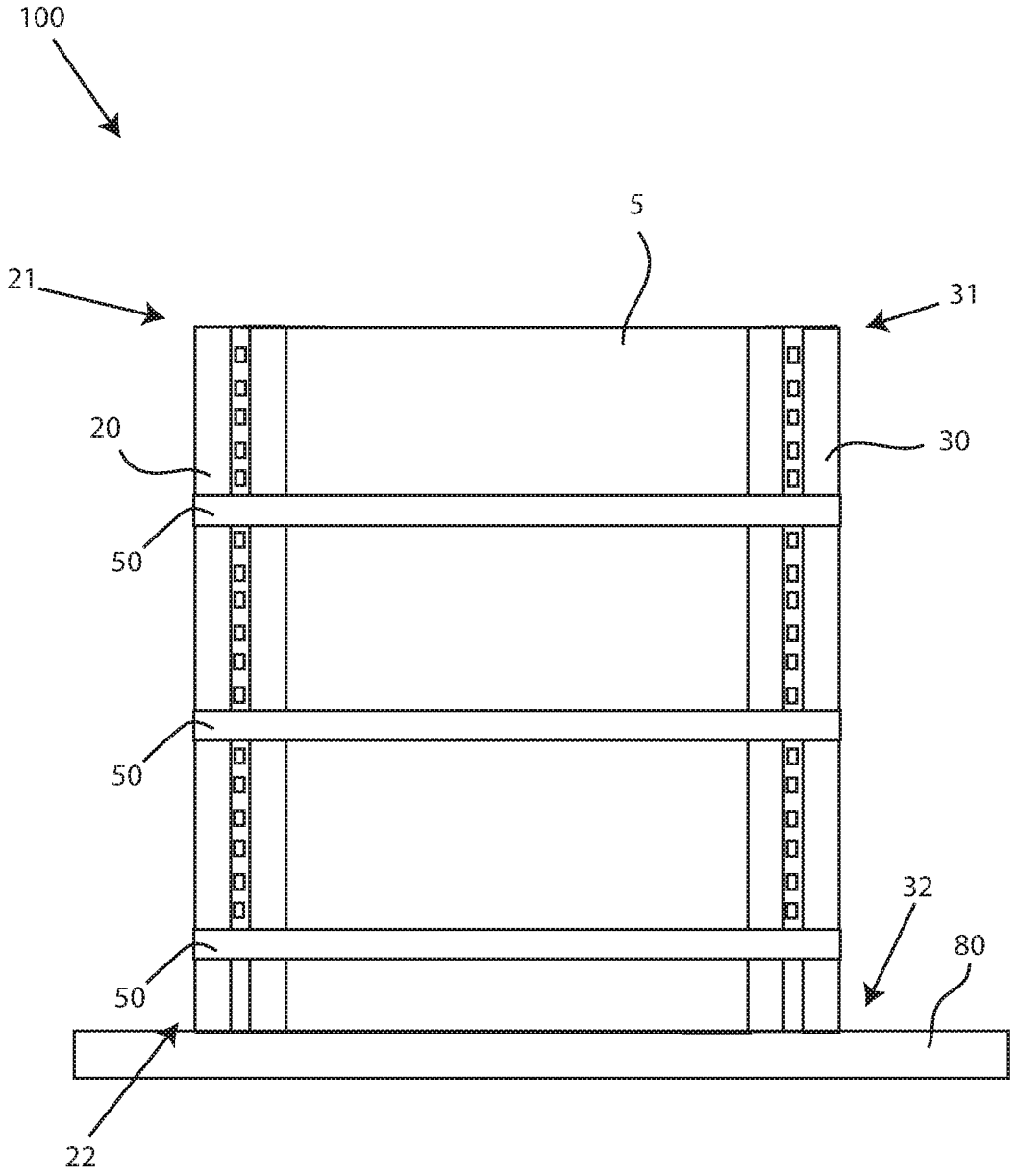
FIG. 2 depicts a front view of an embodiment of the shelving system, with shelves operably coupled to the supports.

Referring to the drawings, FIGS. 1 and 2 depict an embodiment of a shelving system 100. Embodiments of shelving system 100 may be a shelving system, a product display, a gondola, a gravity fed shelving system, a display fixture, an end cap, a retail shelving system, a freestanding display, a product display system, an adjustable shelving system, a stowable shelving system, an automatic adjustable shelving system, or any system, structure, display, or fixture that can display or otherwise accommodate one or more items. Embodiments of the shelving system 100 may be used to display, receive, store, accommodate, stack, present, etc., one or more items, such as retail items, retail products, retail goods, store items, goods, products, items, merchandise, food, foodstuffs, hardware, home goods, produce, tools, and the like. Embodiments of the shelving system 100 may be used or otherwise located on a salesfloor in a retail environment, but could also be used or otherwise located in a receiving area, a stock room, a warehouse, a residential location, and the like.

Moreover, embodiments of the shelving system 100 may include a plurality of supports 20, 30, a wall 5 disposed between the supports 20, 30, a base deck 80, a plurality of shelves 50, an actuator 70, and a lifting mechanism 90. In an exemplary embodiment, the shelving system 100 may include a plurality of supports 20, 30, each support of the plurality of supports 20, 30 having a longitudinal opening 29, 39 defining a channel 28, 38 extending from a first end 21, 31 to a second end 22, 32 of the support 20, 30, the plurality of supports 20, 30 having at least one opening 25 positioned on a surface of the plurality of supports 20, 20, at least one shelf 50, the at least one shelf 50 including an extension 55*a*, 55*b*, the extension 55*a*, 55*b* being positioned within the channel 28, 38 of the plurality of supports 20, 30 to allow a vertical movement of the at least one shelf 50 with respect to the plurality of supports 20, 30, and an actuator 70 operably coupled to the at least one shelf 50, wherein actuation of the actuator 70 permits the vertical movement of the at least one shelf 50 within the channel 28, 38.

Figure 3:
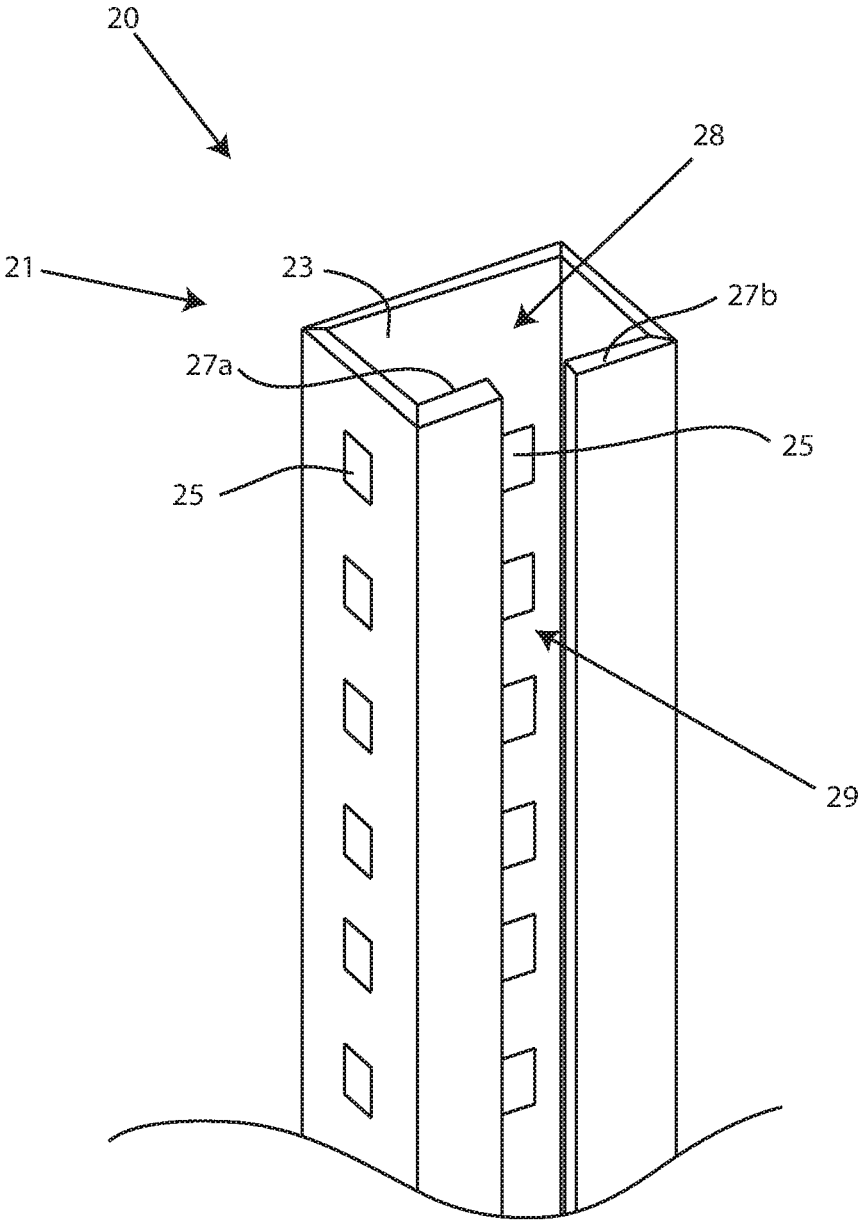
FIG. 3 depicts a perspective view of an embodiment of a support.
Figure 4:
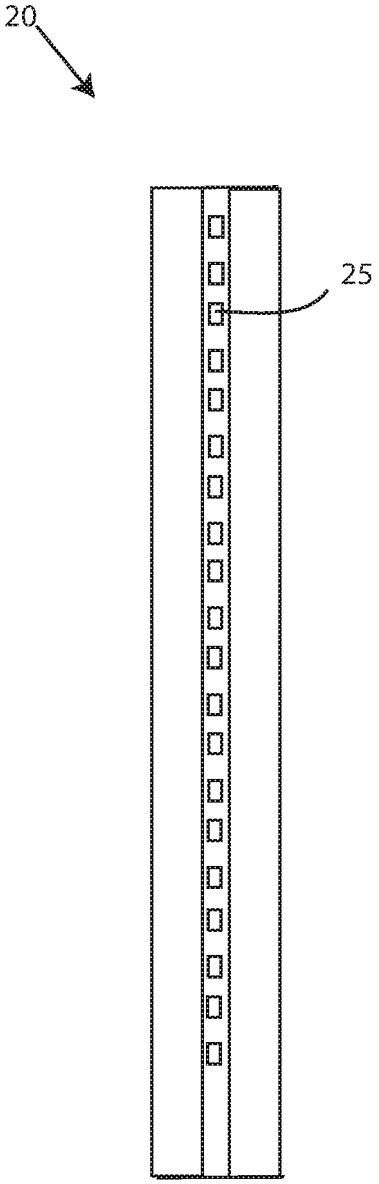
FIG. 4 depicts a front view of an embodiment of the support.
Figure 5:
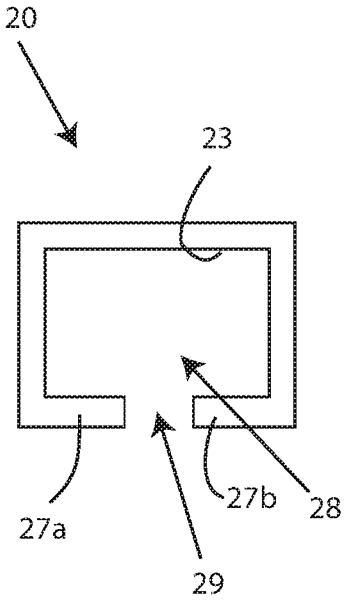
FIG. 5 depicts a top view of an embodiment of the support.

With continued reference to FIGS. 1 and 2, and additional reference to FIGS. 3-5, embodiments of the shelving system 100 may include a first support 20. Embodiments of the first support 20 may be an upright, a post, an upright post, an upright member, a track member, an end frame, a support, a vertical member, a vertical support, a vertical channel member, a support member, a longitudinal member, and the like. The first support 20 may include a first end 21 and a second end 22. The first support 20 may be operably coupled to a base deck 80 proximate or at the second end 22. The connection to the base deck 80 may facilitate the shelving system 100 achieving an upright position when in an assembled position. For instance, the first support 20 may be operably coupled to the base deck 80 proximate the second end 22 of the first support 20 so that the first support may stand erect or otherwise upright. In some embodiments, the first support 20 may be mounted to the base deck 80 using fasteners. Embodiments of the base deck 80 may be configured to contact a ground surface, as well as serve as a bottom shelf of the shelving system 100. The base deck 80 may include one or more components to effectuate a base deck or footing for the shelving system 100.

Furthermore, embodiments of the first support 20 may include a longitudinal opening 29. Embodiments of the longitudinal opening 29 may receive, accommodate, accept, etc. a portion of at least one shelf 50, as described in greater detail infra. Embodiments of the longitudinal opening 29 may be an opening, a channel, a space, a void, a gap, a bore, a hole, a tunnel, and the like. The longitudinal opening 29 may extend from a first end 21 to a second 22 of the first support 20. Embodiments of the longitudinal opening 29 may include a gap between engagement surfaces 27*a* and 27*b*, and a channel 28 between the walls of the first support 20. For instance, embodiments of the longitudinal opening 29 may define or otherwise include a channel 28 of the first support 20. Embodiments of the channel 28 may be a track, a tunnel, a bore, a semi-bore, a void, an opening, a passageway, a pathway, and the like. The channel 28 may extend from a first end 21 of the first support 20 to the second end 22 of the first support 20. The channel 28 may be defined by the walls of the first support 20. FIGS. 3-5 depict the first support 20 having a rectangular cross-section, but a cross-section of the first support 20 may also be square, semi-circular, triangular, curvilinear, cylindrical, elliptical, or polygonal. In other words, the first support 20 may be shaped in various ways, wherein the channel 28 may take the shape of the interior region between the walls of the support 20. For instance, if the first support 20 includes a semi-circular cross-section, then the channel 28 may likewise have a semi-circular shape.

Additionally, embodiments of the first support 20 may include a plurality of cutouts 25. The plurality of cutouts 25 may be positioned along an inner surface 23 of the first support 20. The cutouts 25 may be an opening, a hole, a slot, a bore, a gap, a void in the support 20, and the like. Embodiments of the cutouts 25 may have various shapes, such as rectangular, square, circular, elliptical, diamond shaped, curvilinear, or otherwise polygonal. Embodiments of the cutouts 25 may be positioned on one or more sides of the first support 20. For instance, one or more cutouts 25 may be positioned on a back wall of the first support 20, or may be positioned on three walls of a first support, as shown in FIGS. 3-5. Further, embodiments of the cutouts 25 may be positioned or otherwise disposed along an inner surface, such as surface 23, of the first support 20 between the first end 21 of the first support 20 and the second end 22 of the first support 20. The cutouts 25 may be spaced apart a uniform distance, or location of the cutouts 25 may be predetermined to correspond with one or more locations (e.g. height above ground) of a shelving unit. For instance, each location of a cutout 25 may be a potential location for a shelf 50 with respect to the first support 20.

Embodiments of the shelving system 100 may also include a second support 30. Embodiments of the second support 30 may be the same or substantially the same component. In other words, embodiments of the second support 30 may share the same or substantially the same structure and/or function as the first support 20. Embodiments of the second support 30 may be an upright, a post, an upright post, an upright member, a track member, an end frame, a support, a vertical member, a vertical support, a vertical channel member, a support member, a longitudinal member, and the like. The second support 30 may include a first end 31 and a second end 32, and a longitudinal opening 39 and a channel 38. The second support 30 may be operably coupled to a base deck 80 proximate or at the second end 32, in a same or similar manner as the first support 20. Embodiments of the second support 30 may include engagement surfaces, an inner surface, one or more walls, and may have various cross-sections. In some embodiments, the cross-section of the second support 30 may correspond with the cross-section of the first support 20. In other embodiments, the second support 30 may have a different cross-section than the first support 20.

Further, embodiments of the first support 20 and the second support 30 may have a width, a length, and a height. These dimensions may vary according to the application, the store, the type of product to be displayed, a location within the store, etc. The supports 20, 30 may be comprised of metal, plastic, composite, or a combination of both.

Further, a wall 5 may be disposed between the first support 20 and the second support, as shown in FIGS. 1 and 2. Embodiments of the wall 5 may be operably coupled to one or both of the first support 20 and the second support 30. In some embodiments, the wall 5 may be operably coupled to the base deck 80 in addition to, or in place of, a connection with one or more of the supports 20, 30. Embodiments of the wall 5 may be a wall, a back panel, a panel, a slotwall, a painted slotwall back, a laminate slotwall back, a pegboard, a pegboard back, an insert, a gondola back member, or similar wall-like planar element.

Figure 6:
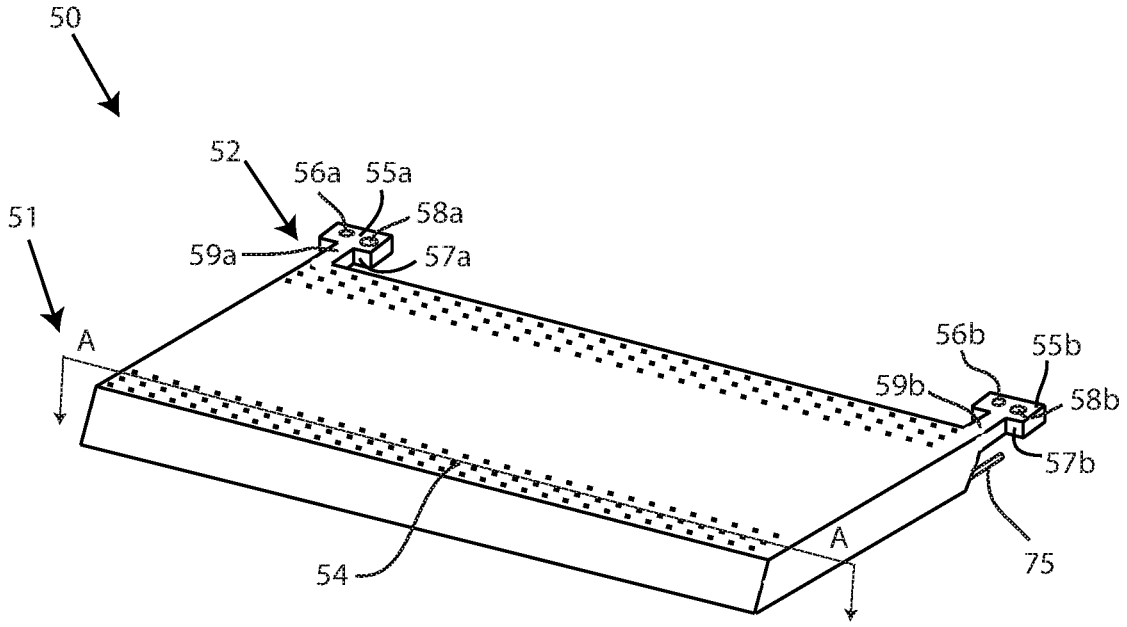
FIG. 6 depicts a perspective view of an embodiment of a shelf.
Figure 7:
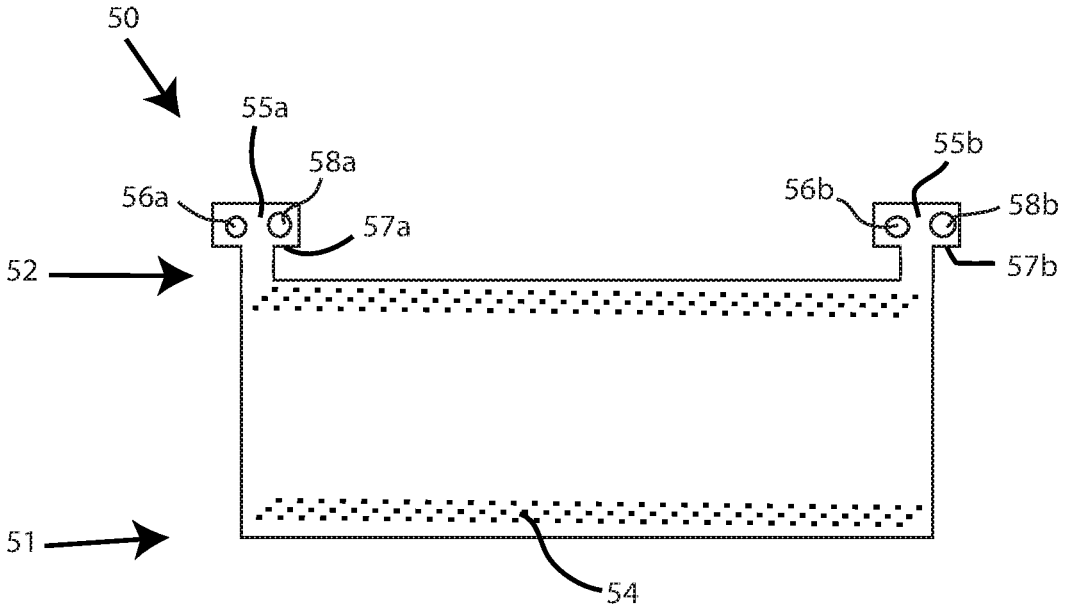
FIG. 7 depicts a top view of an embodiment of the shelf.

Referring now to FIGS. 6 and 7, embodiments of the shelving system 100 may include at least one shelf 50. Embodiments of the shelving system 100 may include a plurality of shelves, such as shelf 50, which cooperate with the plurality of supports 100. For example, embodiments of the shelf 50 may be operably coupled to the plurality of supports 20, 30. Embodiments of the shelf 50 may be a shelf, a gondola shelf, a platform, a counter, a rack, a ledge, and the like, or any component having a surface that can support one or more store items. Each shelf 50 may include a first end 51 and a second end 52. In an exemplary embodiment, the first end 51 of the shelf 50 may be a front end of the shelf 50, and the second end 52 may be a rear or back end of the shelf 50. Embodiments of the shelf 50 may include a first extension 55*a* and a second extension 55*b* proximate, at, or otherwise near the second end 52 of the shelf 50. Embodiments of the extensions 55*a*, 55*b* may protrude a distance from a rear edge of the shelf 50 at each respective corner of the shelf 50. In some embodiments, each shelf 50 of the plurality of shelves may include at least one extension, such as extension 55*a*. In other embodiments, each shelf 50 may include two extensions positions at each corner proximate the second end 52 of the shelf 50. In further embodiments, each shelf may include a third extension that may correspond to a third support, wherein the third support may be positioned between the first support 20 and the second support 30. In yet another embodiment, the shelving system 100 may include some shelves 50 that may have more or less extensions than other shelves 50 in the same shelving system 100.

Moreover, embodiments of the first extension 55*a* may be disposed within the channel 28 of the first support 20, and the second extension 55*b* may be disposed within the channel 38 of the second support 30, when in an assembled position, as shown in FIG. 2. Embodiments of the extensions 55*a*, 55*b* may be sized and dimensioned to fit within the channel 28, 38 of the first support 20 and the second support 30; a shape of the extensions 55*a*, 55*b* may correspond to a shape of the interior region between the walls of the first and second support 20, 30, respectively. For example, in embodiments where the supports 20, 30 include a semi-circular shaped channel 28, 38, then the extensions 55*a*, 55*b* may have a semi-circular shape, and if the supports 20, 30 have a rectangular cross-section, then the extensions 55*a*, 55*b* may also have a rectangular shape. In an exemplary embodiment, the first extension 55*a* may be received by the channel 28 of the first support 20 when in assembled position, wherein the first extension 55*a* may be inserted into the channel 28 from above the first support 20, proximate the first end 21 of the support 20. Likewise, the second extension 55*b* may be received by the channel 38 of the second support 30 when in assembled position, wherein the second extension 55*b* may be inserted into the channel 38 from above the second support 30, proximate the first end 31 of the support 30.

The insertion, loading, and/or assembly of the shelving system 100 may require simultaneous insertion of the extensions 55*a*, 55*b* into the channels 28, 38 of the supports 20, 30. For instance, a shelf 50 may be operably attached to the supports 20, 30 by lifting a shelf 50 above the first ends 21, 31 of the supports 20, 30, aligning the extensions 55*a*, 55*b* with the channels 28, 38, and lowering the shelf 50 such that the extensions 55*a*, 55*b* pass through the channel 28, 38, and the shelf moves vertically with respect to the supports 20, 30. A neck portion 59*a* of the first extension 55*a* may pass through a gap between the engagement surfaces 27*a*, 27*b* of the first support 20, while a neck portion 59*b* of the second extension 55*b* may pass through a gap between two engagement surfaces of the second portion 20. Due to a geometry of the first extension 55*a* and the first support 20, the shelf 50 may be permitted to move only in a vertical or substantially vertical direction within the channel 28. For instance, the first extension 55*a* may include an engagement surface 57*a* that defines an increase in size or width of the first extension 55*a* as compared to the neck portion 59*a*. While the neck portion 59*a* may pass between the two engagement surfaces 27*a*, 27*b* of the first support 20, the rest of the extension 55*a* may not pass through, such that the engagement surface 57*a* of the first extension 55*a* mechanically interferes or otherwise engages the engagement surface 27*a*, 27*b* of the first support 20 to prevent, hinder, or otherwise impede a lateral movement of the shelf 50 with respect to the first support 20. Similarly, due to a geometry of the second extension 55*b* and the second support 30, the shelf 50 may be permitted to move only in a vertical or substantially vertical direction within the channel 38. For instance, the second extension 55*b* may include an engagement surface 57*b* that defines an increase in size or width of the first extension 55*b* as compared to the neck portion 59*b*. While the neck portion 59*b* may pass between the two engagement surfaces of the second support 30, the rest of the extension 55*b* may not pass through, such that the engagement surface 57*b* of the second extension 55*b* mechanically interferes or otherwise engages the engagement surface of the second support 30 to prevent, hinder, or otherwise impede a lateral movement of the shelf 50 with respect to the second support 30. Accordingly, the shelf 50 may move vertically with respect to the supports 20, 30, but may remain within the channels 28, 38 if pulled or otherwise subjected to a lateral or pulling force.

Further, embodiments of the shelf 50 may have a width, a length, and a thickness (or height). These dimensions may vary according to the application, the store, the type of product to be displayed, a location within the store, etc. The shelf 50 may include an interior portion, or an underside that may or may not be fully enclosed. Embodiments of the shelf 50 may be comprised of metal, plastic, composite, or a combination of both.

With continued reference to FIGS. 6 and 7, embodiments of the shelf 50 may include a plurality of holes 54. Embodiments of the holes 54 may be an opening, a hole, a bore, a tunnel, a passageway, a pathway, a void, a slot, and the like. The plurality of holes 54 may be disposed proximate or otherwise near the first end 51 of the shelf 50. In an exemplary embodiment, the plurality of holes 54 may be formed on a top surface of the shelf 50, and may be disposed in a plurality of rows. Embodiments of the holes 54 may have various cross-sections, including circular, diamond, rectangular, square, and the like. In some embodiments, each shelf 50 may include additional rows or sections of holes, similar to holes 54, proximate a rear end 52 of the shelf 50.

Figure 8:
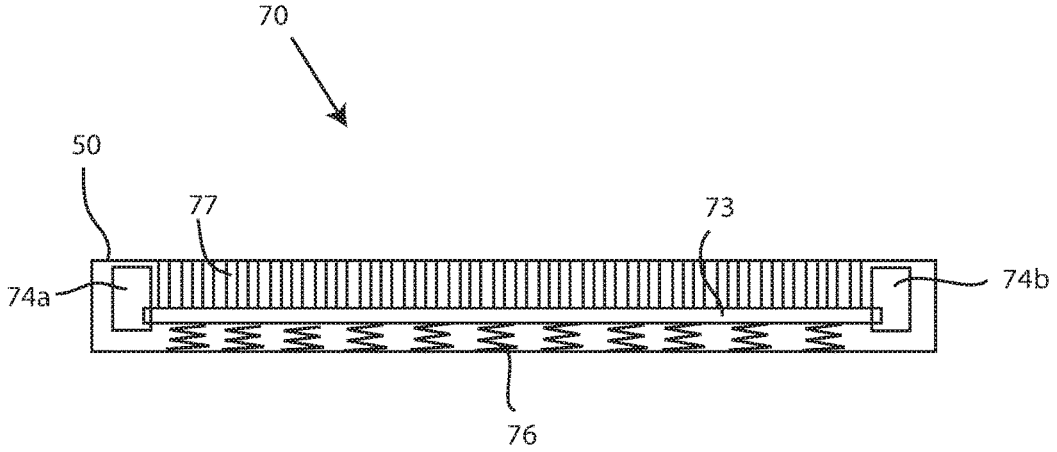
FIG. 8 depicts a front, cross-sectional view across line A-A of an embodiment of an actuator, in a first actuated position.
Figure 9:
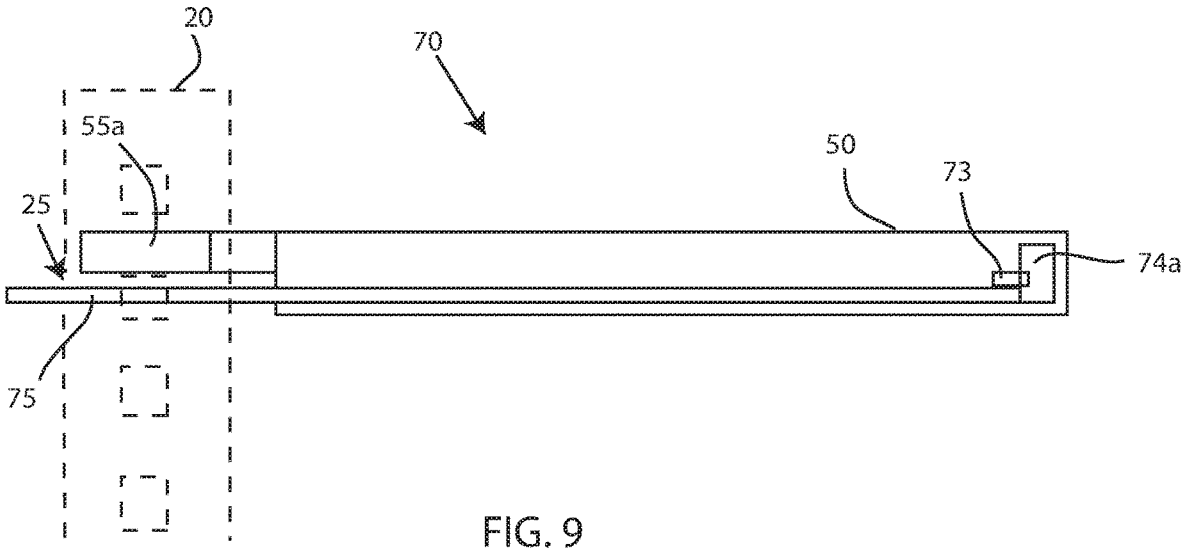
FIG. 9 depicts a side view of an embodiment of the actuator coupled to the shelf, in the first actuated position.

Referring now to FIGS. 8-11, embodiments of the shelving system 100 may include an actuator 70. Embodiments of the actuator 70 may be operably coupled to one or more shelves 50 of the shelving system 50. In an exemplary embodiment, the actuator 70 may be housed or partially housed or enclosed within an interior of the shelf 50, wherein one or more actuator arms 75 may extends from the interior of the shelf 50 housing the actuator 70. In yet another embodiment, the actuator 70 may be fastened or coupled to an underside of the shelf 50. Embodiments of the actuator 70 may include an actuator arm 75 (or two actuator arms, one on each side of the shelf 50), a pressure plate 73, at least one biasing element 76, a first rotation device 74*a*, and a second rotation device 74*b*. Embodiments of the actuator 70 may be actuated to permit the vertical movement of the at least one shelf within the channel 28, 38 by displacing the actuator arm 75 in multiple directions. For instance, actuation of the actuator 70 may cause or disrupt a releasably secure engagement between the shelf 50 and the plurality of supports 20, 30. FIGS. 8 and 9 depict an embodiment of the actuator 70 in a first actuated position. Embodiments of the first actuated position of the actuator 70 may refer to a position when the shelf 50 is releasably secured to at least one support 20, 30. In the releasably secured position, the shelf 50 may be prevented from moving in a vertical direction (via gravity or lifting mechanism 90) because the actuator arm 75, or lever arm, of the actuator 70 extends through at least one cutout 25 of at least one of the supports 20, 30. When the actuator arm 75 extends through the cutout 25, vertical movement can be hindered or prevented due to a mechanical engagement between the edges of the support 20, 30 that define the cutout 25. To achieve the releasably secure position of the shelf 50 with respect to the plurality of supports 20, 30, the actuator arm 75 is displaced forward through the cutout 25 by operation of the first rotation device 74*a*, which is operably connected to the pressure plate 73, which compresses at least one biasing element 76 when a plurality of pins 77 are depressed into the plurality of holes 54 on a top surface of the shelf 50. For instance, the plurality of holes 54 on the shelf 50 may receive, accept, accommodate, etc., pins 77, which may be cylinders, blocks, bars, metal pins, metals bars, keys, plastic pins, plastics pegs, and the like, and may be lightweight and/or rigid elements. The pins 77 may be depressed further into a respective hole 54 of a pin 77 by a weight of a store item placed on the shelf 50. In other words, when a number of store items are located on a shelf 50 near a front edge of the shelf 50, at least one pin 77 may be depressed under the weight of one or more store items. When the pin(s) 77 is depressed by an object(s) located on the shelf 50, the pin 77 may drive the pressure plate 73 against the biasing element 76, which may compress. As the pressure plate is lowered or otherwise displaced by the pins 77, the pressure plate, which is operably coupled to the rotation device 74*a*, 74*b*, may act upon the rotation device 74*a*, 74*b* to rotate or otherwise drive the rotation device 74*a*, 74*b*. Because the actuator arm 75 may be operably coupled to the rotation device 74*a*, movement, rotation, or force may be transferred to the actuator arm 75 to displace the actuator arm 75 in a forward direction (i.e. towards the supports 20, 30) and through a cutout 25 of the first support 20. This may also be the case on the other side of the shelf 50, wherein movement, rotation, or force may be transferred to an actuator arm to displace the actuator arm through a cutout 25 of the second support 30.

Figure 10:
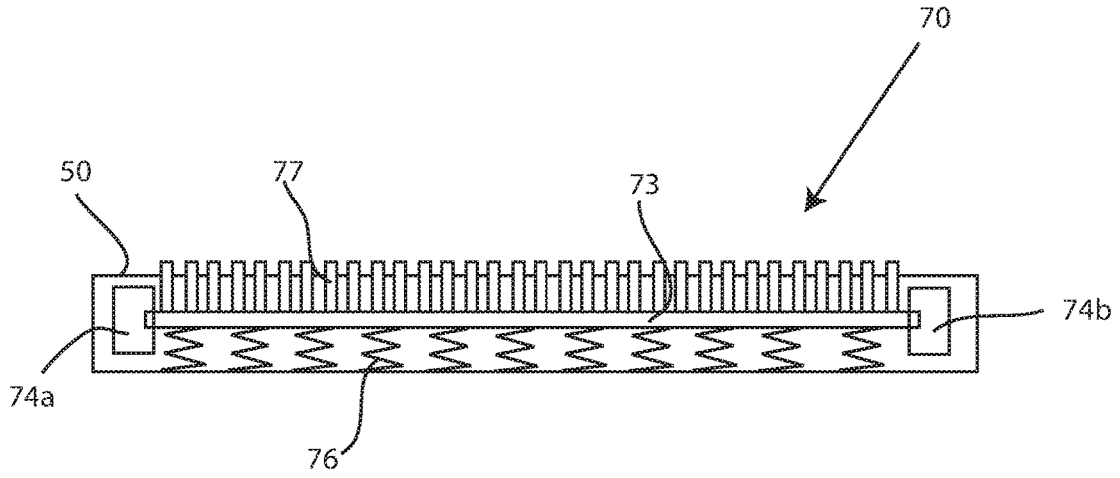
FIG. 10 depicts a front, cross-sectional view across line A-A of an embodiment of the actuator, in a second actuated position.
Figure 11:
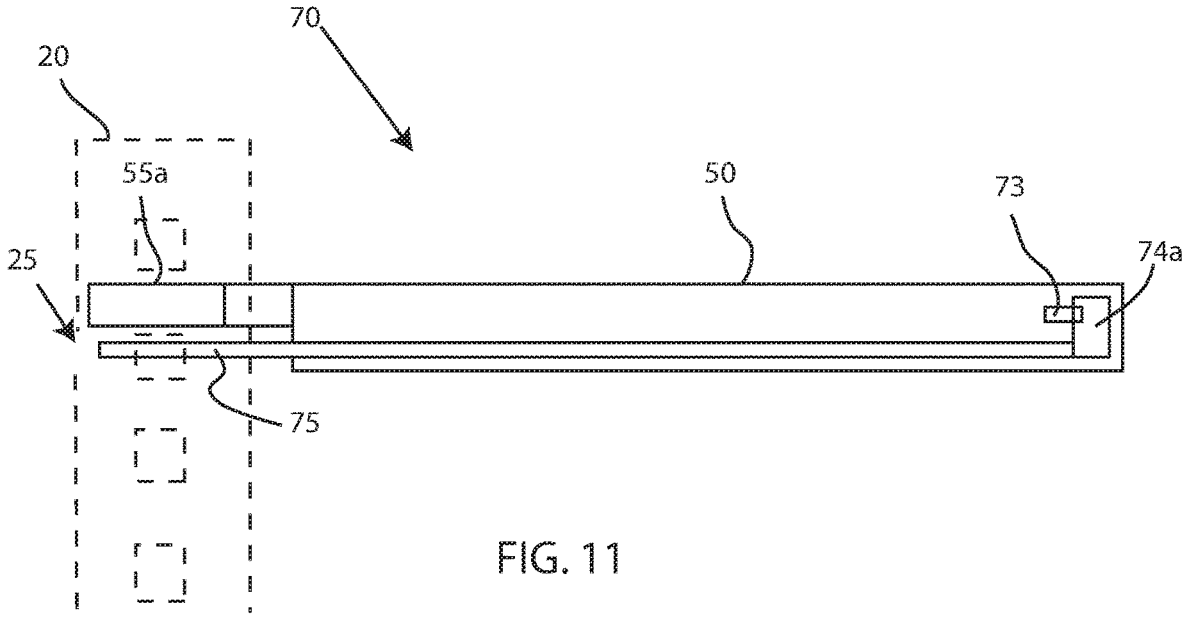
FIG. 11 depicts a side view of an embodiment of the actuator coupled to the shelf, in the second actuated position.

FIGS. 10 and 11 depict an embodiment of the actuator 70 in a second actuated position. Embodiments of the second actuated position of the actuator 70 may refer to a position when the shelf 50 is releasably unsecured to or disengaged from at least one support 20, 30. In the releasably unsecured or disengaged position, the shelf 50 may be permitted from moving in a vertical direction (via gravity or lifting mechanism 90) because the actuator arm 75, or lever arm, of the actuator 70 does not extends through at least one cutout 25 of at least one of the supports 20, 30. When the actuator arm 75 does not extend through the cutout 25, vertical movement can be achieved because the actuator arm 75 does not mechanically engage the edges of the support 20, 30 that define the cutout 25. To achieve the releasably unsecure or disengaged position of the shelf 50 with respect to the plurality of supports 20, 30, the actuator arm 75 is displaced in a rearward direction (i.e. away from the supports 20, 30) through the cutout 25 by operation of the first rotation device 74*a*, which is operably connected to the pressure plate 73, which may be biased or urged upward by the at least one biasing element 76 when a plurality of pins 77 are not depressed into the plurality of holes 54 on the top surface of the shelf 50. For instance, the pins 77 may be urged upward by the at least one biasing element 76 via the pressure plate 73 such that pins 77 may protrude through the holes 54 and extend above the top surface of the shelf 50, when no object(s) are present above the pins 77. When the pin(s) 77 are not fully depressed by an object(s) located on the shelf 50, the biasing element(s) 76 may exert a biasing force against the pressure plate, such that the pressure plate is urged toward the top surface of the shelf 50. Because the pressure plate 73 may be operably coupled to the rotation device 74*a*, 74*b*, the rotation device 74*a*, 74*b* may be acted upon by the pressure plates 73 rotate or otherwise drive the rotation device 74*a*, 74*b*. Because the actuator arm 75 may be operably coupled to the rotation device 74*a*, movement, rotation, or force may be transferred to the actuator arm 75 to displace the actuator arm 75 in a rearward direction (i.e.

away from the supports 20, 30) so that the actuator arm 75 no longer is present within a cutout 25. This may also be the case on the other side of the shelf 50, wherein movement, rotation, or force may be transferred to an actuator arm to displace the actuator arm to clear out the actuator arm 75 from a cutout 25 of the second support 30.

Embodiments of the at least one biasing element 76 may be a spring, a coil spring, an elastomeric element, a compressible element, and the like. Embodiments of the actuator 70 may include a plurality of biasing elements 76. Further, embodiments of the pressure plate 73 may be a plate or similar planar surface component that can extend approximately the width of the shelf 50. Alternatively, embodiments of the actuator 70 may include two or more independent pressure plates 73, which may be placed at corners of the shelf 50, closer to the rotation devices 74*a*, 74*b*. Embodiments of the rotation devices 74*a*, 74*b* may be a gear that can be turned when the pressure plate 73 is lowered or raised, which in turn displaces the actuator arm 75 in either a forward or rearward direction. The gear may be operably coupled to the pressure plate 73 and the actuator arm 75 in such a way that the gear can rotate in a first direction to cause the actuator arm 75 to move forward when the pressure plate 73 is lowered, and then rotate in a second direction to cause the actuator arm 75 to move in a reverse direction when the pressure plate 73 is raised. In further embodiments, the rotation device 74*a*, 74*b* may be a pivot point, which causes the actuator arm 75 to pivot up and into a cutout 25 of a support 20, 30, or pivot in an opposing direction, down and away from the cutout 25 of the support 20, 30. In yet another alternative embodiment, the biasing elements 76 may be disposed beneath the ends of the pins 77, wherein the pressure plate 73 may be disposed underneath the biasing elements 76

Figure 12:
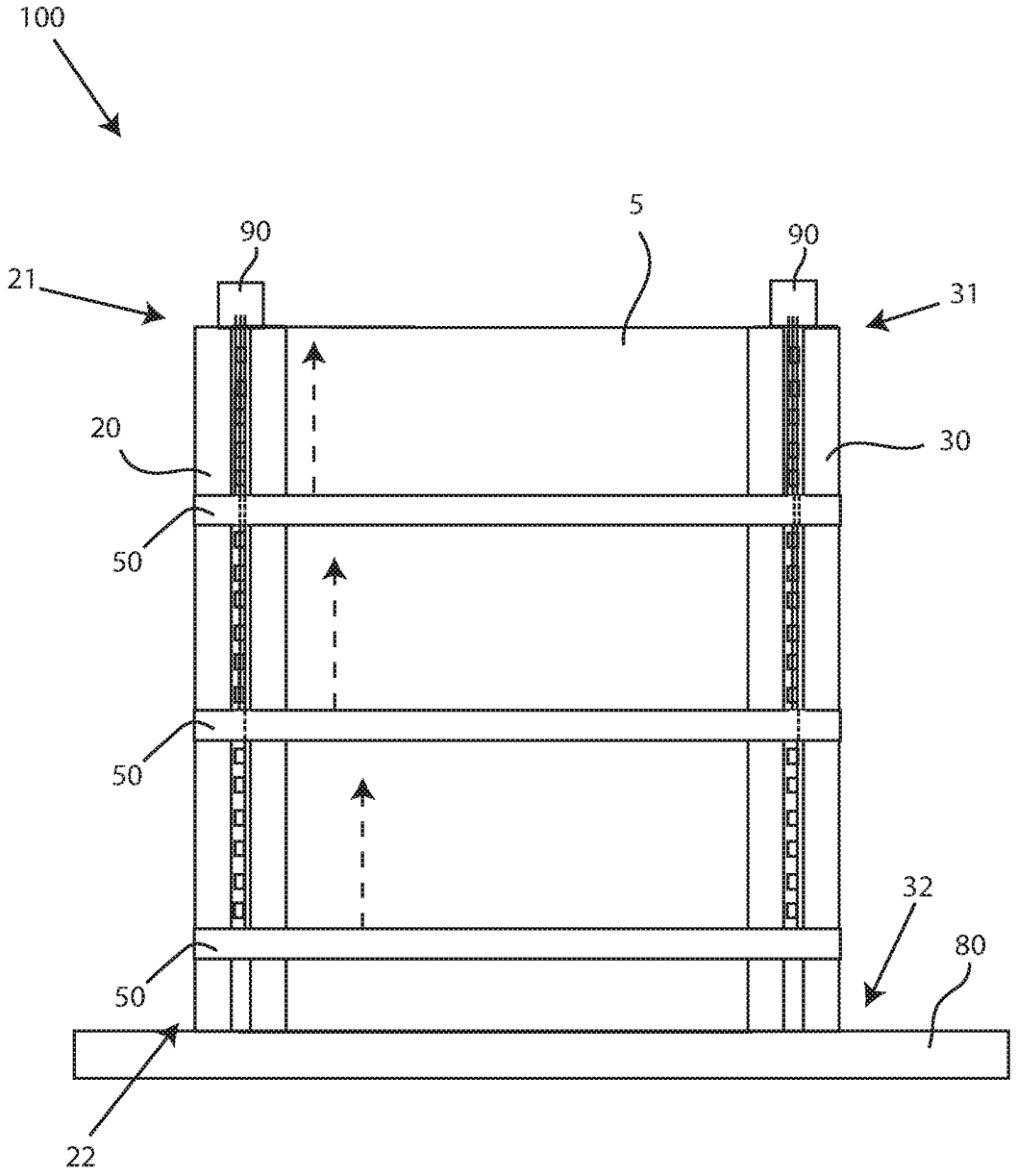
FIG. 12 depicts a front view of an embodiment of the shelving system with a lifting mechanism for raising the shelves.

With reference now to FIG. 12, embodiments of the shelving system 100 may include a lifting mechanism 90. Embodiments of the lifting mechanism 90 may be a lifting means, a lift, a driving means, a displacement mechanism, an elevator system, an elevator, an elevating mechanism, a raise and lowering means, and the like. Embodiments of the lifting mechanism 90 may be mounted or otherwise coupled to the shelving system 100. In some embodiments, the lifting mechanism 90 may be mounted on each of the supports 20, 30, proximate a first end 21, 31. The lifting mechanism 90 may be one or more retractable cord reels, that may be spring loaded to exert a constant, measurable retractable force, wherein a plurality of cords are associated with the one more retractable cord reels. Each of the plurality of cords may be associated with a shelf 50 of the shelving system 100. For example, a first cord may be connected to a retractable cord reel located at a first end 21 of the first support 20, and may extend from the cord reel location through the channel 28 of the first support 20 to a first, top shelf 50. The cord may be operably attached to the first shelf 50. A second cord may be connected to the retractable cord reel of the first cord located at a first end 21 of the first support 20 (or a separate cord reel), and may extend from the cord reel location through the channel 28 of the first support 20 to a second, middle shelf 50. The second cord may pass through a first cord opening 56*a* of the first extension 55*a* of the top shelf 50, and continue to the second shelf, and may be operably attached thereto. A third cord may be connected to the retractable cord reel located at a first end 21 of the first support 20 (or a separate reel), and may extend from the cord reel location through the channel 28 of the first support 20 to a third, bottom shelf 50. The third cord may pass through a second opening 58*a* of the first extension 55*a* of the top shelf 50 and the middle shelf 50, and continue to the third, bottom shelf 50. The third chord may be operably attached thereto.

Embodiments of the shelving system 100 may include a plurality of lifting mechanisms 90. For example, a second, additional lifting mechanism may be operably coupled or mounted to the second support 30 proximate or otherwise near the first end 31. Similar to the lifting mechanism 90 mounted to the first support 20, each of a plurality of cords of the additional lifting mechanism 90 may be associated with a shelf 50 of the shelving system 100. For example, a first cord may be connected to a retractable cord reel located at a first end 31 of the second support 30, and may extend from the cord reel location through the channel 38 of the second support 30 to a first, top shelf 50. The cord may be operably attached to the first shelf 50. A second cord may be connected to the retractable cord reel of the first cord located at a first end 31 of the second support 30 (or a separate cord reel), and may extend from the cord reel location through the channel 38 of the first support 30 to a second, middle shelf 50. The second cord may pass through a first cord opening 56*b* of the second extension 55*b* of the top shelf 50, and continue to the second shelf, and may be operably attached thereto. A third cord may be connected to the retractable cord reel located at a first end 31 of the second support 30 (or a separate reel), and may extend from the cord reel location through the channel 38 of the second support 30 to a third, bottom shelf 50. The third cord may pass through a second opening 58*b* of the second extension 55*b* of the top shelf 50 and the middle shelf 50, and continue to the third, bottom shelf 50. The third chord may be operably attached thereto.

Accordingly, embodiments of the lifting mechanism(s) 90 may raise the plurality of shelves 50 of the shelving system 100 when the shelves 50 are in an unsecured, disengaged position—or a second actuated position. Embodiments of the lifting mechanism 90 may be constantly attempting to retract the shelves 50 of the shelving system 100 due to the nature of the one or more retractable cord reels of the lifting mechanism 90, which retract the plurality of cords or cables that are attached to each of the shelves 50. The engagement of the actuator arm 75 with the supports 20, 30 may prevent or otherwise hinder the retraction of the shelves 50. In other words, actuation of the actuator 70 may permit the vertical movement of the at least one shelf 50 within the channels 28, 38.

The vertical movement of a shelf 50 that no longer has product may be raised by the lifting mechanism(s) 90, so that the shelf 50 may nest or dock with a shelf located above the shelf. For instance, a shelf 50 may be stowed away when product is removed from the shelf 50. The shelf 50 may be stowed away such that the shelf may abut or reside proximate another shelf of the shelving system 100. This automatic lifting or displacement of the shelf 50 may ensure that higher shelves that run out of product sooner are not still blocking a visibility of product located on a lower shelf. In other words, additional space for visibility of products located on a lower shelf may be automatically created when products are removed from higher shelves. Each shelf 50 of the shelving system 100 may be stowable, wherein each of the shelves 50 may be operably coupled to the supports 20, 30 and operably coupled to the lifting mechanism.

While the stowing of the shelves 50 may be done automatically as product is removed from the shelves 50, the shelves 50 may be displaced or stowed away manually. For example, a store representative may manually displace the actuator arm 75 of the actuator 70 to switch from a first actuated position to a second actuated position, and vice versa. The actuator arm 75 may be gripped by the user, and driven forward or rearward as desired. Manual adjustment may allow a user to stow away shelves 50 not needed for a product, or may allow the user to customize the shelving system 100 for various products.

In alternative embodiments, the cords attached to the shelves may include one or more counterweights at an end of the cord to provide a counter weight to the weight of the shelf. The counterweights may be housed in an enclosure positioned proximate the first support 20 and the second support 30, respectively.

Figure 13A:
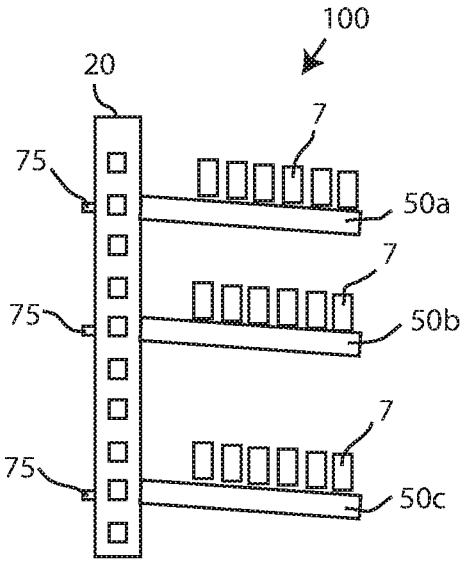
FIG. 13A depicts an embodiment of a shelving system, wherein a top shelf, a middle shelf, and a lower shelf are in a first actuated position, releasably secured to the supports.
Figure 13B:
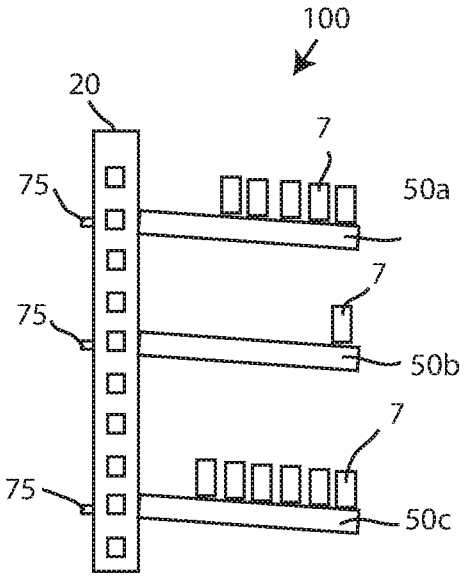
FIG. 13B depicts an embodiment of a shelving system, wherein the top shelf, the middle shelf, and the lower shelf are in the first actuated position, releasably secured to the supports, but only a single store item is located on the middle shelf.
Figure 13C:
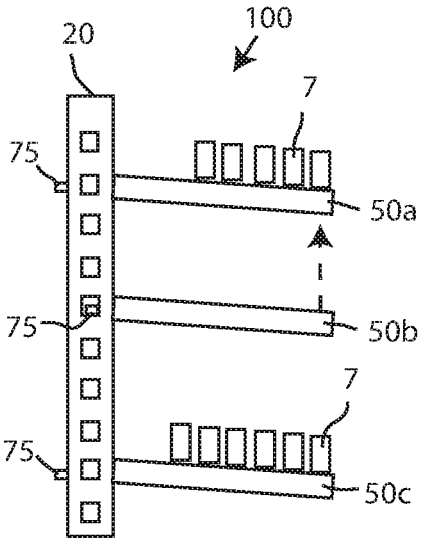
FIG. 13C depicts an embodiment of the shelving system, wherein the top shelf and the bottom shelf are in the first actuated position, releasably secured to the supports and the middle shelf is in a second actuated position, unsecured to the supports.
Figure 13D:
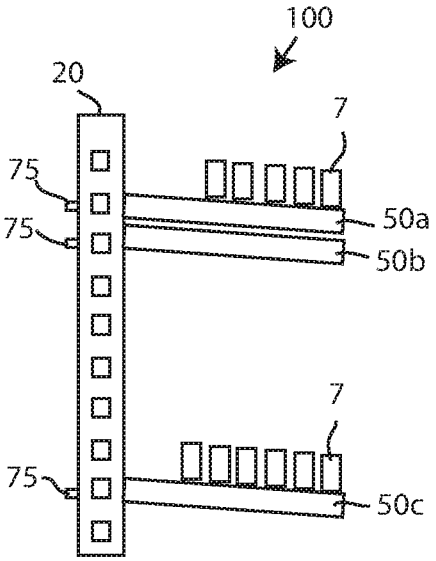
FIG. 13D depicts an embodiment of the shelving system, wherein the middle shelf is stowed away, created additional visibility to the store items still located on the lower shelf 50*c*.

Embodiments of the shelving system 100 may now be described by reference to FIGS. 13A-13D, which depict an exemplary manner in which the shelving system 100 may operate. FIG. 13A depicts an embodiment of a shelving system 100, wherein a top shelf 50*a*, a middle shelf 50*b*, and a lower shelf 50*c* are in a first actuated position, releasably secured to the supports 20, 30. Multiple store items 7 are located on each shelf 50*a*, 50*b* 50*c*, depressing the pins 77 proximate a front edge of the shelves 50*a*, 50*b*, 50*c*. FIG. 13B depicts an embodiment of a shelving system 100, wherein the top shelf 50*a*, the middle shelf 50*b*, and the lower shelf 50*c* are in the first actuated position, releasably secured to the supports 20, 30, but only a single store item 7 is located on the middle shelf 50*b*, still depressing one or more pins 77 proximate a front edge of the shelves 50*a*, 50*b*, 50*c*. In the case of a gravity fed shelving system, the store item is fed to the front edge of the shelf 50*b*; the shelves 50*a*, 50*b*, 50*c* may have an angle between 0°-15° to effectuate the feeding of the store items to the front edge of the shelf. FIG. 13C depicts an embodiment of the shelving system 100, wherein the top shelf 50*a* and the bottom shelf 50*c* are in the first actuated position, releasably secured to the supports 20, 30, and the middle shelf 50*c* is in a second actuated position, unsecured to the supports 20, 30. The retraction force pulling/acting on the middle shelf 50 from the lifting mechanism 90 is now greater than the counter force created by the engagement between the actuator arm 75 and the support 20, 30, and will begin to automatically raise upward within the channels 28, 38 of the supports 20, 30 to stow away and dock with the top shelf 50*a*. FIG. 13D depicts an embodiment of the shelving system 100, wherein the middle shelf 50*b* is stowed away, created additional visibility to the store items 7 still located on the lower shelf 50*c*. The middle shelf 50*b* may abut or reside proximate the top shelf 50*a*, which can act as a stop, to prevent or otherwise hinder additional vertical movement of the middle shelf 50*b* caused by the lifting mechanism 90. The actuator arm 75 of the middle shelf 50*b* may be optionally manually actuated by a store representative so that the middle shelf 50*b* returns to a secure position with respect to the supports 20, 30. As shown in FIG. 13D, embodiments of the shelving system 100 may include stowable shelves 50 that may increase a customer's visibility of products located on a lower shelf.

In alternative embodiments, the actuation may be accomplished through various powered means, such as electromechanical components, hydraulic components, pneumatic components, sensors, switches, linear actuators, motors, servo motors, and the like, and/or a combination thereof. For example, the shelves 50 may include one or more sensors, such as optical or pressure sensors, and the actuator 70 may powered by one or more motor. Further, the lifting means may be accomplished by various lifting mechanisms using electromechanical components, hydraulic components, pneumatic components, and the like.

Referring now FIGS. 1-13D, embodiments of a method for creating additional space for visibility of products 7 located on a lower shelf of a shelving system 100 may include the steps of providing a plurality of supports 20, 30, each support 20, 30 of the plurality of supports 20, 30 having a longitudinal opening 29, 39 defining a channel 28, 38 extending from a first end 21, 31 to a second end 22, 32 of the support 20, 30, the plurality of supports 20, 30 having at least one opening 25 positioned on a surface of the plurality of supports 20, 30, connecting at least one shelf 50 to the plurality of supports 20, 30, wherein the at least one shelf 50 includes an extension 55*a*, 55*b*, the extension 55*a*, 55*b* being positioned within the channel 28, 38 of the plurality of supports 20, 30 to allow a vertical movement of the at least one shelf 50 with respect to the plurality of supports 20, 30, and actuating an actuator 70 operably coupled to the at least one shelf 50, wherein, in response to the actuating, an actuator arm 75 of the actuator 70 disengages from the at least one opening 25 of the plurality of supports 20, 30 to permit a vertical movement of the at least one shelf 50 to expose products 7 placed on the lower shelf 50.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the invention, as required by the following claims. The claims provide the scope of the coverage of the invention and should not be limited to the specific examples provided herein.

What is claimed is:

1. A shelving system, comprising:

a plurality of supports, each support of the plurality of supports having a generally C-shaped cross section defining a longitudinal channel extending from a first end to a second end of each support, the plurality of supports each having a plurality of cutouts positioned on a rear surface of each of the plurality of supports;

a shelf, the shelf including a generally T-shaped extension, the extension being positioned within the longitudinal channel of one of the plurality of supports to allow a vertical movement of the shelf with respect to the plurality of supports; and a lifting mechanism mounted to at least one support of the plurality of supports, the lifting mechanism including a retractable cord reel having a cord that is coupled to the shelf and which raises the shelf vertically in response to a disengagement of an actuator arm of the shelf from a corresponding cutout from the at least one support.

2. The shelving system of claim 1, further comprising an actuator coupled to the shelf.

3. The shelving system of claim 1, wherein the shelf is a first shelf that is raised to dock with a second shelf located above the first shelf to expose store product located on a third shelf located below the first shelf.

4. The shelving system of claim 1, wherein the shelving system is a gravity fed shelving system.

5. The shelving system of claim 1, further comprising a plurality of pins positioned within a plurality of holes proximate a front edge of the shelf.

6. A shelving system comprising:

a first support, the first support including a first plurality of cutouts along an inner surface of the first support;

a second support, the second support including a second plurality of cutouts along an inner surface of the second support, wherein the second support is parallel to the first support;

a first lifting mechanism mounted to the first support, the first lifting mechanism including a first retractable cord reel containing a first cord and a second cord;

a second lifting mechanism mounted to the second support, the second lifting mechanism including a second retractable cord reel containing a third cord and a fourth cord; and a first shelf, the first shelf including:

a first extension portion that includes a first cord opening that receives the first cord from the first retractable cord reel, the first cord being attached to the first shelf, a second cord opening that receives the second cord from the first retractable cord reel, the second cord passing through the second cord opening and attaching to a second shelf located below the first shelf; and a second extension portion that includes a third cord opening that receives the third cord from the second retractable cord reel, the third cord being attached to the first shelf, a fourth cord opening that receives the fourth cord from the second retractable cord reel, the fourth cord passing through the fourth cord opening and attaching to the second shelf located below the first shelf, wherein the first extension portion is configured to vertically move within a channel of the first support, and the second extension portion is configured to move vertically within a channel of the second support, wherein the first shelf is configured to be pulled upward by a retraction of the first cord associated with the first extension portion and the third cord associated with the second extension portion, to stow away and create additional visibility to store products located on a third shelf, which is lower than the first shelf.

7. The shelving system of claim 6, further comprising a wall, the wall being disposed between the first support and the second support.

8. The shelving system of claim 6, further comprising an actuator.

9. The shelving system of claim 6, wherein the shelving system is a gravity fed shelving system.

10. The shelving system of claim 6, further comprising a plurality of pins positioned within a plurality of holes proximate a front edge of the first shelf.

* * * * *